US011646125B2

(12) United States Patent
Paniagua

(10) Patent No.: US 11,646,125 B2
(45) Date of Patent: May 9, 2023

(54) PROCESS FOR MANUFACTURING A CARBON-METAL COMPOSITE MATERIAL AND USE THEREOF FOR MANUFACTURING AN ELECTRIC CABLE

(71) Applicant: NEXANS, Courbevoie (FR)

(72) Inventor: Thibault Paniagua, Lille (FR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/980,828

(22) PCT Filed: Mar. 15, 2019

(86) PCT No.: PCT/FR2019/050590

§ 371 (c)(1),
(2) Date: Sep. 14, 2020

(87) PCT Pub. No.: WO2019/175517

PCT Pub. Date: Sep. 19, 2019

(65) Prior Publication Data

US 2021/0366628 A1 Nov. 25, 2021

(30) Foreign Application Priority Data

Mar. 16, 2018 (FR) ..... 18 52287

(51) Int. Cl.
*H01B 1/18* (2006.01)
*B05D 5/12* (2006.01)

(52) U.S. Cl.
CPC *H01B 1/18* (2013.01); *B05D 5/12* (2013.01)

(58) Field of Classification Search
CPC ... H01B 1/00; H01B 1/02; H01B 1/04; H01B 1/18; B05D 5/12
See application file for complete search history.

(56) References Cited

U.S. PATENT DOCUMENTS 7,538,062 B1 * 5/2009 Dai ..... B01J 35/006 977/890
10,505,201 B2 * 12/2019 Yun ..... H01M 4/9083
2013/0228465 A1 * 9/2013 Zhang-Beglinger ..... C25D 3/30 205/109

FOREIGN PATENT DOCUMENTS

WO 2007033188 3/2007
WO 2011014929 2/2011

OTHER PUBLICATIONS

International Search Report dated May 7, 2019.
Liang Ti Qu et al. "Substrate-Enhanced Electroless Deposition of Metal Nanoparticles on 12-16 Carbon Nanotubes" vol. 127, Jul. 19, 2005 (Jul. 19, 2005).
Liang Ti Qu et al. "Substrate-Enhanced Electroless Deposition of Metal Nanoparticles on Carbon Nanotubes—Supporting Information" Journal of the American Chemical Society, Aug. 1, 2005.

(Continued)

*Primary Examiner* — Mark Kopec
(74) *Attorney, Agent, or Firm* — Sofer & Haroun, LLP

(57) ABSTRACT

The present invention relates to a process for manufacturing a composite material comprising a non-pulverulent carbon-based conductive material and metal nanoparticles dispersed within said non-pulverulent carbon-based conductive material, to said composite material, to the use of the composite material for manufacturing an electrically conductive element, and to an electric cable comprising at least one such composite material, as electrically conductive element.

20 Claims, 1 Drawing Sheet

(56) References Cited

OTHER PUBLICATIONS

Gregory G Wildgoose et al. "Metal Nanoparticles and Related Materials Supported on Carbon Nanotubes: Methods and Applications" S, Wiley—VCH Verlag GMBH & Co. KGAA, DE, Jan. 1, 2006.
Yi Feng et al. "Electroless plating of carbon nanotubes with silver" Journal of Materials Science, Kluwer Academic Publishers, Dordrecht, vol. 39, Jan. 1, 2004 (Jan. 1, 2004).

* cited by examiner

PROCESS FOR MANUFACTURING A CARBON-METAL COMPOSITE MATERIAL AND USE THEREOF FOR MANUFACTURING AN ELECTRIC CABLE

RELATED APPLICATION

This application is a National Phase of PCT/FR2019/050590 filed on Mar. 15, 2019, which in turn claims priority to French Patent Application No. 18 52287, filed on Mar. 16, 2018, the entirety of which is incorporated by reference.

FIELD OF THE INVENTION

The present invention relates to a process for manufacturing a composite material comprising a non-pulverulent carbon-based conductive material and metal nanoparticles dispersed within said non-pulverulent carbon-based conductive material, to said composite material, to the use of the composite material for manufacturing an electrically conductive element, and to an electric cable comprising at least one such composite material as electrically conductive element.

The present invention typically but not exclusively applies to the motor vehicle, aeronautical, computing, electronics (e.g. semiconductors) and construction fields, in which composite materials are increasingly used. Such composite materials may comprise a metal (e.g. aluminium, magnesium, titanium, etc.) matrix and a carbon-based agent (e.g. carbon fibres) as reinforcer. Composite materials are prepared in order to attempt to reconcile the qualities of metals (ductility, conductivity, good resistance to ageing and to high temperatures, etc.) with the lightness and the good mechanical properties characteristic of carbon-based agents.

The present invention applies more particularly to low-voltage (in particular of less than 6 kV) or medium-voltage (in particular from 6 to 45-60 kV) or high-voltage (in particular greater than 60 kV, and which may range up to 800 kV) power cables, whether they are direct current or alternating current, in the fields of overhead, subsea or underground electricity transmission or aeronautics.

More particularly still, the invention relates to an electric cable exhibiting good mechanical properties, in particular in terms of tensile strength, and good electrical properties, in particular in terms of electrical conductivity.

DESCRIPTION OF THE RELATED ART

Many studies have focused on the functionalization and/or modification of carbon nanotubes (CNTs) by metal particles in order to produce CNT-metal nanocomposites. In particular, it is known to deposit metal nanoparticles on the surface of the CNTs without supply or circulation of current, i.e. without it being necessary to artificially supply electrons, in order to reduce the metal ions that it is desired to deposit on the CNTs (method known as "electroless deposition" or ELD). This "electroless" chemical deposition method is based on the simultaneous presence, in an aqueous solution, of metal ions to be reduced (i.e. to be deposited) and of a reducing agent. The reaction also requires the presence of a catalyst, which may be the surface that it is desired to cover or atoms of the metal that it is desired to reduce and deposit. By way of example, international application WO 2014/173793 A1 describes an "electroless" chemical deposition method comprising a step of functionalizing CNTs in order to graft oxygen-containing organic groups (e.g. alcohol, ether, carboxylic acid) to their surface, a step of impregnating CNTs with acid solutions of tin chloride and palladium chloride (catalysts) in order to activate the CNTs, a step of mixing the functionalized and activated CNTs with an aqueous solution containing the salt of metal to be deposited (e.g. $CuSO_4.5H_2O$ if it is desired to deposit copper, silver nitrate if it is desired to deposit silver). The metal ions are reduced by a reducing agent (e.g. formaldehyde) and are deposited at the surface of the CNTs, where highly reactive palladium ions are found. Once the metal (e.g. copper, silver) nanoparticles are deposited, they enable the remainder of the deposition and a metal coating is obtained on the surface of the CNTs. However, this "electroless" chemical deposition method does not make it possible to obtain a high rate of metal growth. Moreover, it is not suitable for enabling the homogeneous dispersion of metal nanoparticles within a non-pulverulent carbon-based conductive material (e.g. carbon nanotubes in the form of fibres or yarns), since such a material requires a penetration of the nanoparticles at the surface but also in depth. Furthermore, the step of activation with tin and palladium results in a source of contamination in the composite material that it is desired to obtain. Finally, only the metal ions having a redox potential higher than that of the reducing agent or CNTs can be reduced at the surface of the CNTs. As the CNTs have a redox potential of +0.5 V vs SHE (standard hydrogen electrode), it is therefore impossible to reduce copper (II) ions $(Cu(NO_3)_2/Cu$, +0.34 V vs. SHE) or silver (I) ions $(Ag(NH_3)_2^+/Ag$, +0.373 V vs. SHE) via an "electroless" chemical deposition without using a reducing agent.

OBJECTS AND SUMMARY

The objective of the present invention is to overcome the disadvantages of the techniques of the prior art by providing a process for manufacturing a carbon-metal composite material, said process being easy to carry out and making it possible to guarantee and to maintain good dispersion of the metal in a carbon-based conductive matrix, and thus to obtain an electrically conductive element exhibiting good mechanical and electrical properties.

A first subject of the present invention is a process for manufacturing a carbon-metal composite material, characterized in that it comprises at least the following steps:

a) immersing a material comprising a metallic support and at least one non-pulverulent carbon-based conductive material deposited on said metallic support, in an emulsion comprising water, at least one precursor of a metal M, at least one surfactant and at least one organic solvent, in order to form a composite material deposited on the metallic support, the metallic support comprising at least one metal M' having a redox potential lower than that of said metal M precursor, and b) washing said composite material deposited on the metallic support resulting from step a).

The process of the invention is easy to carry out and makes it possible to guarantee and to maintain good dispersion of the metal M in the composite material.

In particular, the process of the invention makes it possible to deposit, within the non-pulverulent carbon-based conductive material, metal nanoparticles of said metal M.

According to a preferred embodiment, step a) is of "substrate-enhanced electroless deposition" type, it is therefore preferentially carried out without supply of current, and particularly preferably without the presence of a reducing agent (e.g. without the presence of a reducing agent other than the metal M' of the metallic support).

Owing to the process of the invention, a carbon-metal composite material comprising a non-pulverulent carbon-based conductive material and metal nanoparticles of said metal M dispersed (homogeneously at the surface and at depth) within said non-pulverulent carbon-based conductive material can be easily formed, and makes it possible to obtain a good transfer of mechanical and electrical load between the metal and the carbon in the composite material.

In particular, the use of an emulsion in step a) makes it possible to optimize the dispersion of the non-pulverulent carbon-based conductive material and to make the deagglomeration thereof more effective, thus favouring the deposition of the metal nanoparticles of said metal M within said non-pulverulent carbon-based conductive material.

In the present invention, the expression "conductive material" means a material having a resistivity less than or equal to $1.7\times10^{-6}$ Ω·m approximately, and preferably less than or equal to $1.7\times10^{-8}$ Ω·m approximately.

In the present invention, the expression "carbon-based material" means a material essentially consisting of carbon, i.e. comprising at least 80% by weight approximately of carbon, and preferably at least 99.99% by weight approximately of carbon, relative to the total weight of said carbon material.

The non-pulverulent carbon-based conductive material may be amorphous and/or crystalline.

It is preferably predominantly crystalline, optionally with amorphous portions.

The expression predominantly crystalline means that the crystalline phase or phases of said material represent at least 50 mol %, relative to the total number of moles of said material.

The non-pulverulent carbon-based conductive material of the invention may be amorphous carbon, glassy carbon, graphite, graphene or carbon nanotubes, and preferably carbon nanotubes.

The carbon nanotubes are in particular an allotropic form of carbon belonging to the family of the fullerenes. More particularly, the carbon nanotubes are graphene sheets wound around themselves and closed at their end by hemispheres similar to fullerenes.

In the present invention, the carbon nanotubes comprise both single-wall carbon nanotubes (SWNTs) comprising a single graphene sheet and multi-wall carbon nanotubes (MWNTs) comprising several graphene sheets nested in one another in the manner of Russian dolls, or else a single graphene sheet wound several times around itself.

The carbon of the non-pulverulent carbon-based conductive material of the invention, and in particular the carbon nanotubes, may be functionalized, i.e. may have, at the surface, chemical groups which can be bonded to the metal M, and can optionally bond carbon atoms to one another. Said chemical groups can thus represent sites of attachment between the metal M and the carbon, and optionally between the carbon atoms of said composite material, during the implementation of the process of the invention.

Such chemical groups can be chosen from a halogen atom, a fluoroalkyl group, a fluoroaryl group, a fluorocycloalkyl group, a fluoroaralkyl group, an $SO_3H$ group, a COOH group, a $PO_3H_2$ group, an OOH group, an OH group, a CHO group, a CN group, a COCl group, a COSH group, an SH group and the following groups: R'CHOH, NHR', COOR', SR', CONHR', OR' and $NHCO_2R'$, in which R' is chosen from a hydrogen atom, an alkyl group, an aryl group, an arylSH group, a cycloalkyl group, an aralkyl group, a cycloaryl group and a poly(alkyl ether) group. The direct incorporation of such chemical groups at the surface of said carbon-based material makes it possible to improve the carbon/metal interface during the implementation of the process of the invention.

The functionalization of the carbon-based material promotes in particular the transfer of mechanical and electrical load within the composite material between the carbon and the metal M.

In the present invention, the expression "non-pulverulent material" means a material which is not in the form of a powder.

In particular, the non-pulverulent carbon-based conductive material of the invention may be in the form of a film or of a fibrous material. In other words, the material is in the form of a film or of a material, said film or said material comprising fibres.

The non-pulverulent carbon-based conductive material may have a porosity of at least 5% by volume approximately, preferably of at least 50% by volume approximately, and particularly preferably of at least 80% by volume approximately, relative to the total volume of said non-pulverulent carbon-based conductive material.

The fibres of the fibrous material may be in any one of the following forms: linear (e.g. yarns, rovings), surface fabrics (e.g. UD fabrics, 2D fabrics), 3D fabrics, or mats.

A fabric generally consists of the interlacing of warp yarns and weft yarns. A fabric is generally balanced if the warp weight is equal to the weft weight. It is referred to as unidirectional (i.e. UD fabric) if the warp weight represents preferably more than 70% of the total weight.

By way of example, webs (referred to as ribbons in certain cases) generally consist of fibres that are parallel to one another, oriented in a single direction. The transverse cohesion is provided either by an adhesive ribbon placed according to a given pitch, or by light weaving. A unidirectional fabric is then obtained, in which the weight of fibres in the warp direction represents 98% of the total weight and the remaining 2% provide the transverse cohesion.

The most common 2D fabrics are preferably:

- taffeta weave (or plain weave) in which the warp and weft threads interlace alternately;
- satin weave: the warp yarn floats above several weft threads (e.g. in a 5-satin weave, the warp yarn floats above 4 weft yarns);
- twill weave in which the warp yarn floats above one or more weft yarns and then passes below one or more weft yarns; the difference with satin weave comes from the shift in the weaving points between two consecutive rovings which never touch one another for satin weave.

2D fabrics are easier to handle than the webs and offer advantageous properties in two directions.

The fibre mats are made with assemblies of yarns of which the lengths are generally about 50 mm.

3D fabrics group together a very large number of types of weavings. The advantage of these types of weaving lies in the weaving of yarns according to the thickness which makes it possible to keep different layers together.

A fibrous material in the form of mats of CNT fibres is preferred.

The metal M is the metal that it is desired to deposit within the non-pulverulent carbon-based conductive material.

The metal M is chosen preferably from copper, nickel, tin, gold and silver.

The precursor of metal M may comprise metal ions of said metal M. In that case, the metal M' has a redox potential lower than that of the metal ions of said precursor of metal M.

The precursor of said metal M may be a salt of a metal M chosen from a copper salt, a nickel salt, a tin salt, a gold salt and a silver salt.

A copper salt is preferred.

The salt of metal M may be chosen from sulfates, sulfamates, and halides (chlorides) of metal M.

According to a preferred embodiment, the metal salt is anhydrous copper sulfate ($CuSO_4$), copper sulfate hydrate ($CuSO_4.5H_2O$), anhydrous nickel sulfamate ($H_4N_2NiO_6S_2$), dehydrated tin chloride ($H_4Cl_2O_2Sn$), gold chloride ($AuCl_3$) or silver chloride (AgCl).

The surfactant may be a cationic or anionic surfactant, and preferably a cationic surfactant.

In particular, the surfactant is chosen from sodium dodecylsulfate (SDS), octyltrimethylammonium bromide (OTAB), and hexadecyltrimethylammonium bromide (CTAB).

The surfactant used in step a) promotes the formation of an emulsion and thus the penetration of the metal ions of the precursor of metal M within the non-pulverulent carbon-based conductive material during step a).

The organic solvent may make it possible to promote the formation of an emulsion and the diffusion of said emulsion within the non-pulverulent carbon-based conductive material. Specifically, the non-pulverulent carbon-based conductive material, and in particular the CNTs, are generally highly hydrophobic and difficult to disperse within a liquid medium.

The organic solvent is preferably a polar aprotic solvent, in particular chosen from ketones, nitriles and a mixture thereof.

According to a particularly preferred embodiment of the invention, the organic solvent is chosen from acetone, acetonitrile, butanone, dimethyl sulfoxide and a mixture thereof.

The metal of the metallic support may be any metal which after oxidation and for a certain pH value (dependent on said metal) enables the formation of a stable ionic compound.

The metal of the metallic support is preferably aluminium, nickel, or zinc.

The metal of the metallic support preferably has a degree of oxidation of zero.

The metallic support may be in the form of a metal sheet, a plate, a bar, a tube, a reel, a capstan, or a pulley, notably one of the surfaces of which is substantially equivalent to one of the surfaces of the non-pulverulent carbon-based conductive material in order in particular to enable the deposition of the non-pulverulent carbon-based conductive material on said metallic support.

During step a), the metal of the metallic support will oxidize and transfer its electrons to the non-pulverulent carbon-based conductive material, leading to the reduction of the metal ions of the precursor of metal M directly at the surface of and at depth in the non-pulverulent carbon-based conductive material and thus the formation of a carbon-metal composite material deposited on said metallic support. Said composite material obtained comprises said non-pulverulent carbon-based conductive material and metal nanoparticles of said metal M dispersed in said non-pulverulent carbon-based conductive material.

The emulsion may comprise from 40% to 90% by weight approximately of water, and preferably from 50% to 80% by weight approximately of water, relative to the total weight of the emulsion.

The emulsion may comprise from 1% to 15% by weight approximately of said precursor of a metal M, and preferably from 2% to 10% by weight approximately of said precursor of a metal M, relative to the total weight of the emulsion.

The emulsion may comprise from 0.05% to 5% by weight approximately of said surfactant, and preferably from 0.5% to 3% by weight approximately of said surfactant, relative to the total weight of the emulsion.

The emulsion may comprise from 5% to 40% by weight approximately of said organic solvent, and preferably from 10% to 30% by weight approximately of said organic solvent, relative to the total weight of the emulsion.

Preferably, the emulsion comprises:

from 40% to 80% by weight approximately of water, from 2% to 15% by weight approximately of at least one precursor of a metal M, from 0.5% to 5% by weight approximately of at least one surfactant, and from 10% to 40% by weight approximately of at least one organic solvent, relative to the total weight of the emulsion.

The emulsion may further comprise at least one complexing agent.

The complexing agent may make it possible to prevent the precipitation of the metal M during step a), in particular when the metal M is copper and the aqueous phase of the emulsion is basic.

The complexing agent may be chosen from 2,2',2",2'"-(ethane-1,2-diyldinitrilo)tetraacetic acid (EDTA), potassium sodium tartrate ($KNaC_4H_4O_6$).

The emulsion may comprise from 0.1% to 10% by weight approximately of complexing agent, and preferably from 2% to 5% by weight approximately of complexing agent, relative to the total weight of the emulsion.

Step a) may last from 5 min to 1 h approximately, and preferably from 5 to 30 min approximately.

The reaction time of step a) depends on the amount of metal nanoparticles that it is desired to incorporate in the non-pulverulent carbon-based conductive material.

The water is preferably distilled water.

Step a) may be carried out under mechanical or ultrasonic stirring or using any other system for circulating the liquid (e.g. hydraulic pump).

Step b) makes it possible to deswell, contract (or redensify) the non-pulverulent carbon-based conductive material in which the metal nanoparticles are deposited and dispersed homogeneously during step a). This step b) thus makes it possible to trap the metal nanoparticles in said non-pulverulent carbon-based conductive material.

The trapping of the nanoparticles of metal M during step b) is mainly carried out by elimination of the organic solvent and of the precursor of metal M which has not reacted in the emulsion.

During step b), the composite material deposited on the metallic support resulting from step a) may be washed one or more times with an acidic aqueous solution having a pH ranging from 2 to 4 approximately.

The acidic aqueous solution may be an aqueous solution of sulfuric acid, phosphoric acid or hydrochloric acid.

Said material may further be washed one or more times with distilled water.

The process of the invention may further comprise, between step a) and step b), a step during which the composite material deposited on the metallic support resulting from step a) is removed from the emulsion, in particular by filtration or by manual removal.

The process may further comprise, after step b), a step c) of separating the composite material and the metallic support.

Step c) may be carried out manually.

The process may further comprise, after step c), a step d) of washing the composite material, in particular with distilled water.

The process may further comprise, after step d), a step e) of drying the composite material, in particular with absorbent paper or in air.

The process may further comprise, before step a), a step $a_0$) of preparing the emulsion as defined previously.

In one particular embodiment, step $a_0$) is carried out at ambient temperature, and preferably in air.

Step $a_0$) may comprise the following sub-steps:

$a_{0-1}$) the mixing of water, at least one precursor of metal M possibly in solution, and optionally at least one complexing agent possibly in solution, in order to form an aqueous phase comprising the precursor of metal M and optionally the complexing agent, $a_{0-2}$) adjusting the pH of the aqueous phase resulting from step $a_{0-1}$), $a_{0-3}$) adding at least one organic solvent to the aqueous phase from step $a_{0-2}$), $a_{0-4}$) adding at least one surfactant to the mixture from step $a_{0-3}$), it being understood that steps $a_{0-1}$) to $a_{0-4}$) are carried out under stirring and the stirring being maintained from one step to the next, $a_{0-5}$) maintaining the stirring of the mixture from step $a_{0-4}$) for at least 1 h approximately, and preferably for at least 24 h approximately, in order to form an emulsion.

The precursor of metal M, the complexing agent, the organic solvent and the surfactant are as defined previously.

The stirring during steps $a_{0-1}$) to $a_{0-5}$) may be carried out by means of mechanical vibrations or ultrasonic waves.

The stirring during step $a_{0-1}$) makes it possible to promote the dissolution of the metal precursor, and of the complexing agent if there is one, in water.

The stirring during the following steps $a_{0-2}$) to $a_{0-5}$) makes it possible to promote the formation of an emulsion.

Mechanical vibrations are preferred and are generally implemented with a magnetic stirrer at a speed ranging from 250 to 1000 rpm (rotations per minute) approximately.

Step $a_{0-2}$) makes it possible to obtain an aqueous phase having the appropriate pH to enable the metallic support to oxidize during step b).

By way of example, when the metal M' of the metallic support is aluminium, the pH of the aqueous phase may advantageously be adjusted to a value of around 13. When the metal of the metallic support is nickel, the pH of the aqueous phase may advantageously be adjusted to a value of around 7.

A person skilled in the art will be able to choose an appropriate pH depending on the metal used for the metallic support.

The pH is adjusted in particular by adding a few drops of a base (e.g. sodium hydroxide) or of an acid (e.g. sulfuric acid) to the aqueous phase of step $a_{0-1}$).

The process may further comprise, before step a), a step a') of preparing the material comprising a metallic support and at least one non-pulverulent carbon-based conductive material deposited on said metallic support.

By way of example, the material may be prepared by fastening the non-pulverulent carbon-based conductive material to said metallic support, in particular by any fastening system that makes it possible to ensure intimate contact between the non-pulverulent carbon-based conductive material and the metallic support such as adhesive bonding.

The process of the invention preferably does not comprise step(s) that involve the use of a binder, in particular of organic polymer(s) type. Indeed, the good penetration of the metal nanoparticles in the non-pulverulent carbon-based conductive material according to step a), and also the trapping thereof according to step b), are sufficient to ensure a good carbon/metal cohesion.

The process of the invention preferably does not comprise step(s) that involve the use of a reducing agent.

The process of the invention preferably does not include a supply of current.

A second subject of the invention is a composite material obtained according to the process in accordance with the first subject of the invention, characterized in that it comprises a non-pulverulent carbon-based conductive material and metal nanoparticles of a metal M which are dispersed within said non-pulverulent carbon-based conductive material.

The non-pulverulent carbon-based conductive material is as defined in the first subject of the invention.

The metal M is as defined in the first subject of the invention.

The metal nanoparticles of metal M may have a size ranging from 1 to 250 nm approximately, and preferably ranging from 1 to 10 nm approximately.

The composite material of the invention may have a porosity of at most 20% by volume approximately and preferably of at most 5% by volume approximately, relative to the total volume of said composite material.

Scanning electron microscopy (SEM) analyses have shown that the metal nanoparticles of metal M are dispersed at the surface and at depth in the non-pulverulent carbon-based conductive material.

Preferably, the composite material of the invention is free of organic polymer(s). Specifically, the presence of organic polymers may degrade its electrical properties, in particular its electrical conductivity after the shaping thereof.

In one particular embodiment, the composite material of the invention consists only of the non-pulverulent carbon-based conductive material and metal nanoparticles of a metal M dispersed within said non-pulverulent carbon-based conductive material.

According to a preferred embodiment of the invention, the composite material comprises from 0.01% to 10% by weight approximately of carbon and from 90% to 99.99% by weight approximately of metal M, relative to the total weight of said material.

A third subject of the invention is the use of a composite material in accordance with the second subject or obtained according to the process in accordance with the first subject for manufacturing an electrically conductive element, in particular an electric cable.

A fourth subject of the invention is an electric cable, characterized in that it comprises at least one composite material in accordance with the second subject or obtained according to the process in accordance with the first subject as electrically conductive element.

Said cable has improved mechanical and electrical properties.

The electric cable of the invention may comprise a plurality of electrically conductive elements, each of said electrically conductive elements being a composite material in accordance with the second subject of the invention or obtained according to the process in accordance with the first subject of the invention.

In a particular embodiment, the electric cable of the invention further comprises at least one electrically insulating layer surrounding said electrically conductive element or the plurality of electrically conductive elements, said electrically insulating layer comprising at least one polymer material.

The polymer material of the electrically insulating layer of the cable of the invention may be chosen from crosslinked and noncrosslinked polymers, polymers of the inorganic type and polymers of the organic type.

The polymer material of the electrically insulating layer may be a homopolymer or a copolymer having thermoplastic and/or elastomeric properties.

The polymers of the inorganic type may be polyorganosiloxanes.

The polymers of the organic type may be polyolefins, polyurethanes, polyamides, polyesters, polyvinyls or halogenated polymers, such as fluoropolymers (e.g. polytetrafluoroethylene PTFE) or chloropolymers (e.g. polyvinyl chloride PVC).

The polyolefins may be chosen from ethylene and propylene polymers. Mention may be made, as examples of ethylene polymers, of linear low-density polyethylenes (LLDPEs), low-density polyethylenes (LDPEs), medium-density polyethylenes (MDPEs), high-density polyethylenes (HDPEs), ethylene/vinyl acetate copolymers (EVAs), ethylene/butyl acrylate copolymers (EBAs), ethylene/methyl acrylate copolymers (EMAs), ethylene/2-hexylethyl acrylate (2HEA) copolymers, copolymers of ethylene and of α-olefins, such as, for example, polyethylene/octenes (PEOs), ethylene/propylene copolymers (EPRs), ethylene/ethyl acrylate copolymers (EEAs) or ethylene/propylene terpolymers (EPTs), such as, for example, ethylene/propylene/diene monomer terpolymers (EPDMs).

More particularly, the electric cable in accordance with the fourth subject of the invention may be an electric cable, of power cable type. In this case, the electric conductive element is surrounded by a first semiconductive layer, the first semiconductive layer being surrounded by an electrically insulating layer and the electrically insulating layer being surrounded by a second semiconductive layer.

In a particular embodiment, generally in accordance with the electric cable of the invention, the first semiconductive layer, the electrically insulating layer and the second semiconductive layer constitute a three-layer insulation. In other words, the electrically insulating layer is directly in physical contact with the first semiconductive layer and the second semiconductive layer is directly in physical contact with the electrically insulating layer.

The electric cable of the invention may further comprise a metallic shield surrounding the second semiconductive layer.

This metallic shield can be a "wire" shield composed of an assembly of conductors made of copper or aluminium arranged around and along the second semiconductive layer, a "tape" shield composed of one or more conductive metal tapes positioned helically around the second semiconductive layer, or a "waterproof" shield of metal tube type surrounding the second semiconductive layer. The latter type of shield makes it possible in particular to form a barrier to the moisture which has a tendency to penetrate the electric cable in a radial direction.

All the types of metallic shields can play the role of earthing the electric cable and can thus transmit fault currents, for example in the event of short-circuit in the network concerned.

In addition, the cable of the invention may comprise an external protective sheath surrounding the second semiconductive layer or else more particularly surrounding said metallic shield, when it exists. This external protective sheath may be made conventionally from appropriate thermoplastic materials, such as HDPEs, MDPEs or LLDPEs; or else materials which retard flame propagation or withstand flame propagation. In particular, if the latter contain no halogen, reference is made to sheathing of HFFR (Halogen-Free Flame Retardant) type.

Other layers, such as layers which swell in the presence of moisture, can be added between the second semiconductive layer and the metallic shield, when it exists, and/or between the metallic shield and the external sheath, when they exist, these layers making it possible to ensure the longitudinal watertightness of the electric cable.

DETAILED DESCRIPTION

EXAMPLE

Preparation of a Composite Material in Accordance with the First Subject of the Invention A 1 mol/l aqueous copper sulfate solution was prepared. Next, separately, a 1 mol/l aqueous solution of EDTA complexing agent was prepared. 140 ml of the aqueous copper sulfate solution, 150 ml of the aqueous complexing agent and 60 ml of distilled water were mixed to form a resulting aqueous phase which was stirred using a conventional magnetic stirrer at around 600 rpm. The resulting aqueous solution became sky blue, then its pH was adjusted to a pH of 12.6, using a 10 mol/l NaOH solution.

100 ml of acetone as organic solvent were added to the resulting aqueous solution, and also 1 g of OTAB as surfactant, while keeping the resulting emulsion under stirring. Then, the stirring was continued for 24 h.

At the same time, a mat of carbon nanotubes manufactured by the Department of Materials Science and Metallurgy of Cambridge University (UK) was attached with tweezers to a metallic support made of aluminium having dimensions of 70 mm×50 mm×2 mm. Next, the metallic support+NTC assembly was introduced and immersed in the emulsion formed previously for 2 minutes, then removed and washed twice with a 0.1 mol/l acidic aqueous solution of hydrochloric acid and twice with distilled water. The metallic support made of aluminium and the composite material formed were then separated, and the composite material was washed once with distilled water then dried with absorbent paper.

Figure 1:
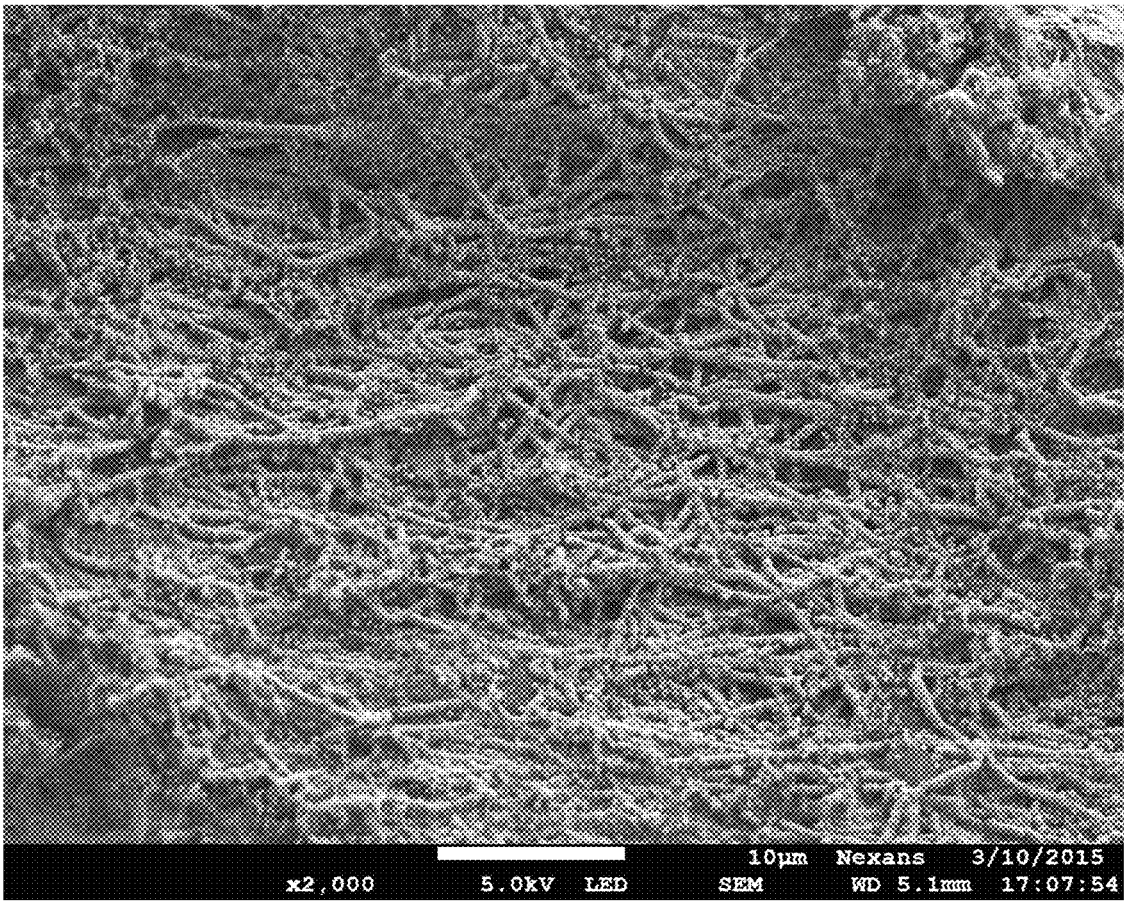
FIG. 1 represents a scanning electron microscopy image of the composite material formed in accordance with one embodiment.

FIG. 1 represents a scanning electron microscopy image taken with a JEOL 7800F microscope of the composite material formed according to the process of the invention and shows the homogeneous dispersion of the copper nanoparticles with a size of 50 nm in the CNT network, at the surface and at depth.

The composite material obtained comprised 1% by weight of carbon and 99% by weight of copper.

Figure 2:
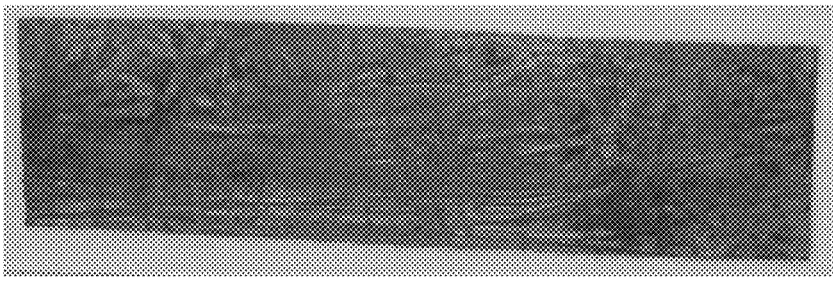
FIG. 2 represents a photograph of the composite material obtained according to the process of the invention.

FIG. 2 represents a photograph of the composite material obtained according to the process of the invention.

The invention claimed is:

1. A process for manufacturing a carbon-metal composite material, said method comprising the steps of:

a) immersing a material comprising a metallic support and at least one non-pulverulent carbon-based conductive material deposited on said metallic support, in an emulsion comprising water, at least one precursor of a metal M, at least one surfactant and at least one organic solvent, in order to form the carbon-metal composite material deposited on the metallic support, the carbon-metal composite material comprising the non-pulverulent carbon-based conductive material and metal nanoparticles of said metal M, the metallic support comprising at least one metal M' having a redox potential lower than that of said metal M precursor, and b) washing the carbon-metal composite material deposited on the metallic support resulting from step a).

2. The process according to claim 1, wherein the non-pulverulent carbon-based conductive material is amorphous carbon, glassy carbon, graphite, graphene or carbon nanotubes.

3. The process according to claim 1, wherein the non-pulverulent carbon-based conductive material is in the form of a film or a fibrous material.

4. The process according to claim 3, wherein the fibres of the fibrous material are in any of the following forms: linear, surface fabrics, 3D fabrics, or mats.

5. The process according to claim 1, wherein the precursor of said metal M is a salt of a metal M chosen from a copper salt, a nickel salt, a tin salt, a gold salt, and a silver salt.

6. The process according to claim 1, wherein the surfactant is chosen from sodium dodecylsulfate, octyltrimethylammonium bromide, and hexadecyltrimethylammonium bromide.

7. The process according to claim 1, wherein the organic solvent is chosen from acetone, acetonitrile, butanone, dimethyl sulfoxide and a mixture thereof.

8. The process according to claim 1, wherein the metal of the metallic support is aluminium or zinc.

9. The process according to claim 1, wherein the emulsion comprises:

from 40% to 80% by weight of water, from 2% to 15% by weight of at least one precursor of a metal M, from 0.5% to 5% by weight of at least one surfactant, and from 10% to 40% by weight of at least one organic solvent, relative to the total weight of the emulsion.

10. The process according claim 1, wherein step a) lasts from 5 min to 1 h.

11. The process according to claim 1, said process further comprises, after step b), a step c) of separating the carbon metal composite material and the metallic support.

12. The process according to claim 1, wherein the metal M is chosen from copper, nickel, tin, gold and silver.

13. The process according to claim 1, wherein step a) is of Substrate-Enhanced Electroless Deposition type.

14. The process according to claim 1, wherein the precursor of said metal M comprises metal ions of said metal M to be reduced into said metal nanoparticles of said metal M.

15. The process according to claim 14, wherein the metal M' has a redox potential lower than that of the metal ions of said metal M.

16. The process according to claim 1, wherein the metal nanoparticles of said metal M have a size ranging from 1 to 250 nm.

17. The process according to claim 1, wherein the metal nanoparticles of said metal M have a size ranging from 1 to 10 nm.

18. The process according to claim 1, wherein the metal nanoparticles of said metal M are formed from the precursor of said metal M.

19. The process according to claim 1, wherein the metal nanoparticles of said metal M are dispersed within the non-pulverulent carbon-based conductive material.

20. The process according to claim 19, wherein the metal nanoparticles of said metal M are homogeneously dispersed at the surface and at depth in the non-pulverulent carbon-based conductive material.

* * * * *